US005864737A

United States Patent [19]

Obu et al.

[11] Patent Number: 5,864,737

[45] Date of Patent: Jan. 26, 1999

[54] IMAGE FORMING DEVICE WHICH FORMS AN ELECTRIC FIELD TO DISCHARGE AN OBJECT

[75] Inventors: Makoto Obu, Yokohama; Seiichi Miyakawa, Nagareyama; Kunio Hibi; Kozoh Sudoh, both of Yokohama; Hidenori Kanno; Youichi Ueda, both of Shibata-machi; Toshio Inada, Yokohama; Yusuke Takeda, Yokohama; Sadayuki Iwai, Yokohama, all of Japan

[73] Assignee: Ricoh Company, Ltd., Tokyo, Japan

[21] Appl. No.: 722,307

[22] Filed: Sep. 27, 1996

[30] Foreign Application Priority Data

| | | | |
|---|---|---|---|
| Aug. 21, 1924 | [JP] | Japan | 7-274685 |
| Feb. 7, 1996 | [JP] | Japan | 8-021248 |
| Feb. 8, 1996 | [JP] | Japan | 8-046729 |
| Mar. 9, 1996 | [JP] | Japan | 8-080570 |
| Jun. 27, 1996 | [JP] | Japan | 8-186754 |

[51] Int. Cl.[6] ..... G03G 15/02; G03G 15/16

[52] U.S. Cl. ..... 399/176; 361/225; 399/296

[58] Field of Search ..... 399/174, 175, 399/176, 296; 361/225, 230, 235

[56] References Cited

U.S. PATENT DOCUMENTS

| | | | |
|---|---|---|---|
| 3,981,498 | 9/1976 | Fletcher | 399/176 X |
| 4,626,876 | 12/1986 | Miyagawa et al. | 347/140 |
| 4,803,593 | 2/1989 | Matsumoto et al. | 361/225 |
| 4,811,158 | 3/1989 | Kani et al. | 361/230 |
| 5,146,280 | 9/1992 | Kisu | 399/176 |
| 5,270,768 | 12/1993 | Murata | 399/176 |
| 5,293,200 | 3/1994 | Tsusaka | 361/230 X |
| 5,371,579 | 12/1994 | Bisaiji | 399/296 X |
| 5,406,359 | 4/1995 | Fletcher | 399/296 |
| 5,557,373 | 9/1996 | Miyashita et al. | 399/176 X |
| 5,600,414 | 2/1997 | Hyllberg | 399/176 |

FOREIGN PATENT DOCUMENTS

| | | |
|---|---|---|
| 61-036751 | 2/1986 | Japan . |

*Primary Examiner*—Fred L. Braun

*Attorney, Agent, or Firm*—Oblon, Spivak, McClelland, Maier & Neustadt, P.C.

[57] ABSTRACT

An apparatus which forms a discharge electric field in order to discharge an object. The apparatus includes an electrode member facing and separated by a preselected gap from the object, and a power source which applies a discharge voltage to the electrode member to thereby cause discharge to occur between the object and the electrode member. Further, the electrode member at the gap includes a material selected in association with the gap so that a functional relationship between the discharge voltage and a discharge current caused by the discharge voltage is a continuous function.

41 Claims, 9 Drawing Sheets

IMAGE FORMING DEVICE WHICH FORMS AN ELECTRIC FIELD TO DISCHARGE AN OBJECT

BACKGROUND OF THE INVENTION

The present invention relates to an electric field forming device for forming an electric field which causes discharge to occur between the field forming device and an image carrier or similar object. Also, the present invention relates to an image forming apparatus of the type using a developing liquid and capable of controlling charge for charging a toner image and charge for transferring a toner image in combination to thereby ensure high image quality.

[Prior Art 1]

A copier, facsimile apparatus, printer or similar image forming apparatus usually includes a device for charging the surface of an image carrier uniformly, a device for removing needless charge from the same surface, and a device for transferring a toner image from the image carrier to a recording medium. These kind of devices will be referred to as discharge electric field forming devices hereinafter. Another discharge electric field forming device is taught in, e.g., Japanese Patent Application No. 7-158558 and used to obviate troubles including the disfigurement of the toner image. This electric field forming device causes discharge to occur between it and the image carrier so as to enhance the cohesion of toner forming the toner image and adhesion acting between the toner and the image carrier.

The discharge electric field forming devices are generally classified into two types of devices, i.e., contact type devices and non-contact type devices. In each contact type device, a voltage is applied to a conductive roller, conductive brush or similar electrode member which is held in contact with the object to be charged. In this condition, a discharge electric field is formed between the electrode member and the object in the vicinity of the position where they contact. In each non-contact type device, the electrode member faces, but does not contact, the object, so that the discharge electric field is formed between the electrode member and the object.

A problem with the above contact type device is that if the surface of the object contacting the electrode member has pin holes or similar defects, a current concentrates on the defects and obstructs uniform discharge. For uniform discharge, it is a common practice to provide the voltage with particular waveforms or to select particular materials for the electrode member. When the electrode member is implemented as a conductive roller formed of rubber or sponge, as conventional, it needs disproportionate costs for the material and fabrication. Further, in this type of device, discharge occurs at opposite sides of the contacting portion, so that it brings about a great amount of ozone and other undesirable products. In addition, the electrode member contacting the image carrier or similar object is likely to contaminate or even scratch the surface of the object.

By contrast, the non-contact type device produces a minimum of ozone and other products and scarcely contaminates or damages the surface of the object. Moreover, the non-contact type device does not disturb the toner image formed on the image carrier because the electrode member does not contact the image carrier. The device is therefore applicable even to a discharge electric forming device for causing discharge to occur between it and the image carrier prior to the transfer of the toner image.

However, even the non-contact type device has a problem that uniform discharge cannot be formed between it and the object, resulting in irregular charging, irregular discharging, irregular image transfer, etc. Some different schemes have heretofore been proposed to guarantee uniform discharge in this type of device. For example, when the electrode member is implemented as a flat semiconductive electrode, the electrode member may be provided with a particular resistance, or the contamination on the surface of the electrode facing the object may be removed by an AC voltage. However, even these schemes cannot fully obviate the above irregularity. Furthermore, when the non-contact type device is used to cause discharge to occur between it and the image carrier of the image forming apparatus, the irregular discharge renders the cohesion of the toner irregular and deteriorates image quality.

We conducted a series of studies and experiments on uniform discharge which is essential with the non-contact type device. The studies and experiments showed that a discharge voltage and discharge current characteristic (referred to as a V-I characteristic hereinafter) belonging to a group of discharge characteristics has some relation with the discharge condition in the gap between the electrode member and the object. Specifically, it was observed by eye that the discharge is sometimes not uniform and includes a number of bright points in the above gap (referred to as bright point discharge hereinafter), but is sometimes uniform over the entire gap (referred to as uniform discharge hereinafter). It was also found that the bright point discharge occurs when the V-I characteristic is such that the discharge current rises sharply and discontinuously at a discharge start voltage Vs, but the uniform discharge is attainable when the V-I characteristic is such that the discharge current rises continuously even around the discharge start voltage Vs. In the case of the bright point discharge, the discharge occurred locally in the gap between the object and the electrode member, resulting in the irregular charging. Such a relation led us to a conclusion that if the electrode member is so configured as to implement a V-I characteristic causing the discharge current to vary continuously even around the discharge start voltage Vs, uniform discharge can be set up between the electrode member and the object.

[Prior Art 2]

In an electrophotographic image forming apparatus using a developing liquid, i.e., liquid carrier and toner dispersed in the carrier, a latent image formed on the surface of an image carrier (photoconductive element) is developed by the liquid to turn out a toner image. The toner image is transferred from the image carrier to a recording medium. An electrostatic transfer system is a specific form of this kind of transfer system and forms an electric field between the image carrier and the recording medium. Toner particles forming the toner image on the image carrier are caused to move to the recording medium by electrophoresis. For electrophoresis, corona charge opposite in polarity to the toner may be applied from the rear to the recording medium arrived at the toner image. Also known in the art are a transfer system causing the recording medium to contact the toner image with a transfer roller and applying a bias opposite in polarity to the toner to the roller, and a transfer system laying a recording medium being conveyed by a transfer belt on a toner image and applying a bias opposite in polarity to the toner from the rear of the belt. In this type of apparatus, the amount of charge necessary for image transfer depends on the amount of charge of the toner image existing on the photoconductive element. As for the amount of charge of the toner image, the charge deposited by a set roller or similar toner image charging device for causing the toner to electrostatically cohere is predominant. A developing device included in the apparatus using the developing liquid has a developing roller for depositing the developer on the photoconductive element, and a reverse roller or squeeze roller rotatable in the opposite direction to the photoconductive element for removing the excess liquid from the element. A set roller or toner image charging device is interposed between the developing device and the image transferring device in order to electrostatically set the toner on the photoconductive element. The set roller deposits charge on the toner image moved away from the developing device in order to increase its charge. As a result, the adhesion of the toner to the photoconductive element is enhanced to protect the toner image from disfigurement.

In the apparatus of the type using the developing liquid, the image quality is determined by the combination of the charge deposited by the toner image charging device and the charge deposited by the image transferring device, as stated earlier. However, no specific methods for controlling their relation adequately have been proposed in the past. It has been customarily for a person with expert knowledge to determine optimal values, relying on their knowledge, perception, and trial and error. This kind of adjustment is inefficient and renders maintenance at the user's station time- and labor-consuming.

SUMMARY OF THE INVENTION

It is therefore an object of the present invention to provide a discharge electric field forming device ensuring the uniform or substantially uniform charging of a object by obviating the bright point discharge.

It is another object of the present invention to provide an image forming apparatus ensuring, with the above discharge electric field forming device, high image quality by obviating the deterioration of images.

It is another object of the present invention to provide an image forming apparatus of the type using a developing liquid and capable of presenting, despite the combined control over the amount of charge for the toner and the amount of image transfer charge, an optimal range of adjusted values for each of them as a guideline, thereby facilitating adjustment at the time of, e.g., maintenance and enhancing image quality.

In accordance with the present invention, a device for forming a discharge electric field for an object to be discharged includes an electrode member facing, but not contacting, the object, and a power source for applying a voltage to the electrode member to thereby cause discharge to occur between the object and the electrode member. A preselected gap exists between the object and the electrode member. A discharge current to flow toward the object in response to the voltage applied from the power source to the electrode member has a characteristic so controlled as not to become sharp or discontinuous when the voltage is at and around a discharge start voltage.

Also, in accordance with the present invention, in a device of the type described, the object and electrode member are spaced from each other by a gap sufficient to cause the discharge to occur. The electrode has a base formed of aluminum, and a hard layer of alunite which is a compound of potassium aluminum sulfate, sold under the trademark name ALUMITE, formed on the surface of the base facing the object.

Also, in accordance with the present invention, in a device of the type described, the object and electrode member are spaced by a gap sufficient to cause the discharge to occur. The electrode member has a surface layer implemented by porous sintered metal.

Also, in accordance with the present invention, an image forming apparatus includes an image carrier for forming a latent image thereon. A discharge electric field forming device forms a discharge electric field between the discharge electric field forming device and the image carrier to thereby charge the image carrier. A latent image forming device forms the latent image on the image carrier charged by the discharge electric field forming device. A developing device develops the latent image to thereby produce a corresponding toner image. An image transferring device transfers the toner image to a recording medium. The discharge electric field forming device has an electrode member facing, but not contacting, an object to be discharged, and a power source for applying a voltage to the electrode member to thereby cause discharge to occur between the object and the electrode member. A preselected gap exists between the object and the electrode member. A discharge current to flow toward the object in response to the voltage applied from the power source to the electrode member has a characteristic so controlled as not to become sharp or discontinuous when the voltage is at and around a discharge start voltage.

Further, in accordance with the present invention, an image forming apparatus includes a latent image forming device for forming a latent image on an image carrier. A developing device develops the latent image to thereby form a corresponding toner image. An image transferring device transfers the toner image to a recording medium. A discharge electric field forming device forms a discharge electric field between the discharge electric field forming device and the image carrier. The discharge electric field forming device has an electrode member facing, but not contacting, an object to be discharged, and a power source for applying a voltage to the electrode member to thereby cause discharge to occur between the object and the electrode member. A preselected gap exists between the object and the electrode member. A discharge current to flow toward the object in response to the voltage applied from the power source to the electrode member has a characteristic so controlled as not to become sharp or discontinuous when the voltage is at and around a discharge start voltage.

Furthermore, in accordance with the present invention, an image forming apparatus includes a latent image forming device for forming a latent image on an image carrier. A developing device develops the latent image to thereby form a corresponding toner image. An image transferring device transfers the toner image to a recording medium. A discharge electric field forming device forms a discharge electric field between the discharge electric field forming device and the image carrier. The discharge electric field forming device has an electrode member facing, but not contacting, an object to be discharged, and a power source for applying a voltage to the electrode member to thereby cause discharge to occur between the object and the electrode member. The object and electrode member are spaced from each other by a gap sufficient to cause the discharge to occur. The electrode has a base formed of aluminum, and a hard alunite layer formed on the surface of the base facing the object.

Moreover, in accordance with the present invention, an image forming apparatus has a latent image forming device for forming a latent image on an image carrier. A developing device develops the latent image to thereby form a corresponding toner image. An image transferring device transfers the toner image to a recording medium. A discharge electric field forming device forms a discharge electric field between the discharge electric field forming device and the image carrier. The discharge electric field forming device has an electrode member facing, but not contacting, an object to be discharged, and a power source for applying a voltage to the electrode member to thereby cause discharge to occur between the object and the electrode member. The object and electrode member are spaced by a gap sufficient to cause the discharge to occur. The electrode member has a surface layer implemented by porous sintered metal.

In addition, in accordance with the present invention, in an electrophotographic apparatus using a developing liquid and causing, after a toner image formed on a photoconductive element has been caused to cohere by charge applied from a toner image charging device, an image transferring device to transfer the toner image from the photoconductive element to a recording medium, an amount of charge to be deposited by the image transferring device is selected to be 20% to 100% of an amount of charge to be deposited by the toner image charging device.

BRIEF DESCRIPTION OF THE DRAWINGS

The above and other objects, features and advantages of the present invention will become more apparent from the following detail description taken with the accompanying drawings in which.

DESCRIPTION OF THE PREFERRED EMBODIMENTS

1st Embodiment

Figure 1:
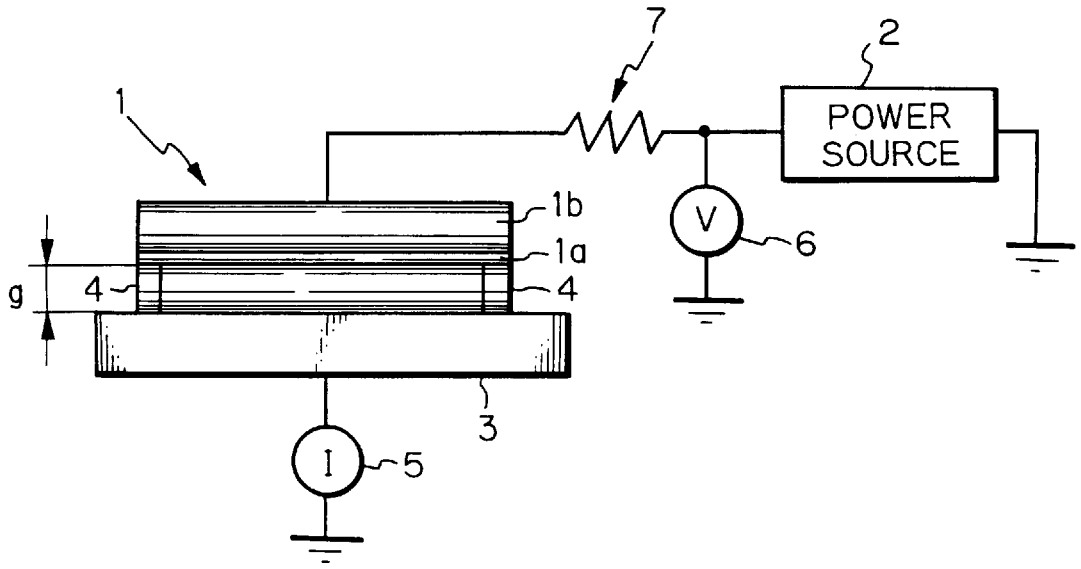
FIG. 1 schematically shows a charging device representative of a first embodiment of the present invention.

Referring to FIG. 1 of the drawings, a charging device of the type forming a discharge electric field and representative of a first embodiment of the present invention is shown. As shown, the charging device has an electrode member 1 and a power source 2 for applying a voltage to the electrode member 1. The electrode member 1 faces, but does not contact, an object 3 to be charged. A spacer 4 defines a small gap g between the electrode member 1 and the object 3. In the illustrative embodiment, the gap g is selected to be greater than 10 $\mu$m inclusive. An ammeter 5 is connected between the object 3 and ground in order to measure a discharge current flow due to discharge. The output terminal of the power source 2 is connected to ground via a voltmeter 6 which measures a voltage to be applied to the electrode member 1. A resistor 7 is connected between the electrode member 1 and the power source 2 and has a resistance selected on the basis of the electrode resistance of the member 1. However, the resistor 7 may be omitted, depending on the characteristic of the electrode member 1. Also, the object 3 is implemented as a metal plate in order to measure a discharge current. However, when the discharge electric field forming device is applied to an electrophotographic image forming apparatus, as will be described later, a photoconductor or similar dielectric body having an electrode on its rear plays the role of the body 3. The electrode of the dielectric body serves as a substrate at the same time.

Figure 2:
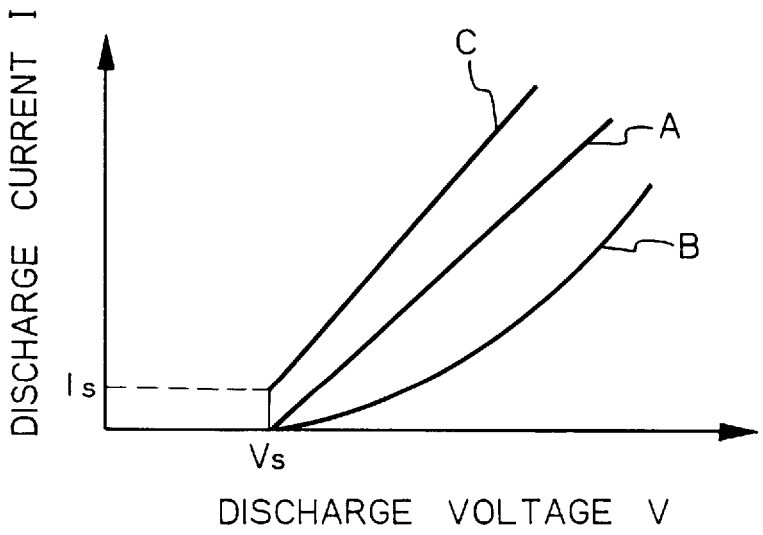
FIG. 2 is a graph showing a relation between a discharge current and a discharge voltage.

FIG. 2 is a graph showing a relation between a discharge current I (ordinate) to flow to the ammeter 5 and a discharge voltage V (abscissa) measured by the voltmeter 6. The relation was determined by setting, one at a time, a plurality of electrode members 1 each being formed of a particular material on the device shown in FIG. 1, and sequentially varying the voltage applied from the power source 2 to the members 1. The current I is shown in terms of an amount of current for a unit sectional area of the discharge region. For example, when a cylindrical electrode member having a length of 5 cm and a diameter of 20 mm and a metallic body having a flat surface were set on the device of FIG. 1 in parallel to each other, and a negative voltage was applied to cause discharge to occur, a 0.2 cm wide (and 5 cm long) discharge region was observed. For this reason, the current I in FIG. 2 is a value produced by dividing the current measured by the ammeter 5 by the area of the 0.2 cm wide, 5 cm long discharge region.

In FIG. 2, curves A and B represent metals each having a particular kind of film on its surface while a curve C represents metal whose surface is exposed to the outside.

The gap between the object 3 and the electrode member 1 shown in FIG. 1 is filled with air. Therefore, as shown in FIG. 2, glow discharge began when the voltage applied to the electrode member 1 was higher than the field strength represented by the Paschen's characteristic, without regard to the material of the electrode member 1. For example, when the gap g was 75 $\mu$m, and a discharge start voltage Vs setting up a discharge field strength of about 10 V/$\mu$m for a discharge area of 1 $cm^2$ was applied, a discharge current I started to flow between the electrode member 1 and the object 3 due to glow discharge.

However, the curves A, B and C each showed a particular characteristic in the vicinity of the discharge start voltage Vs. Specifically, the curve C shows that the discharge current rose sharply and discontinuously at the voltage Vs. By contrast, the curves A and B each show that the discharge current rose continuously with the rise of the voltage Vs. In this manner, the previously mentioned V-I characteristic depends on the material of the electrode member 1.

It was also observed by eye that the V-I characteristics shown in FIG. 2 and the discharge condition are correlated. As for the V-I characteristics represented by the curves A and B, uniform discharge occurred over the entire gap g. As for the V-I characteristic represented by the curve C, bright point discharge with a number of bright points was observed in the gap g. With some of the materials having the V-I characteristic represented by the curve A, it was found that bright point discharge was introduced into the uniform discharge in a long time of discharge.

Figure 3:
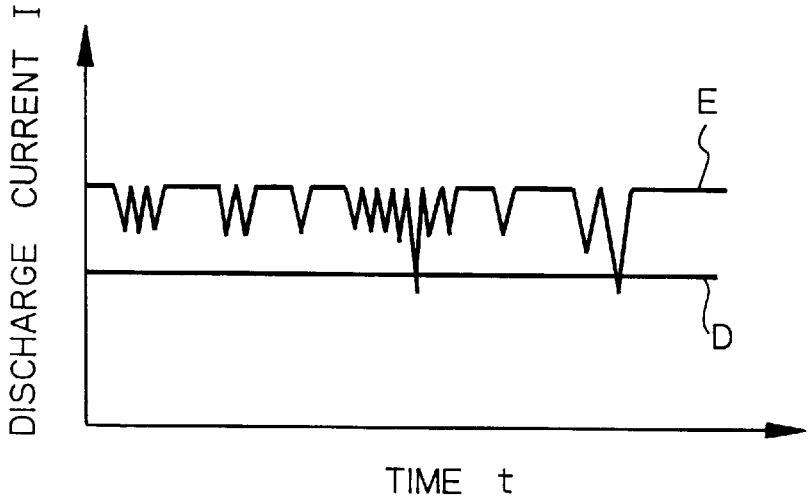
FIG. 3 is a graph showing the variation of the discharge current with respect to time.

FIG. 3 shows specific waveforms of discharge currents derived from a given voltage. In FIG. 3, the obscissa and ordinate indicate time t and discharge current I, respectively. As shown, data D shows that the discharge current is constant and corresponds to the uniform discharge stated above, while data E shows that the discharge current is irregular and corresponds to the bright point discharge. In a strict sense, the current is flat for one period of time, but becomes irregular for another period of time, as the data E indicates. During such a flat period, the uniform discharge occurs. However, as for the samples having the V-I characteristic represented by the curve C, the flat period was relatively short and not frequent, so that the bright point discharge was observed by eye.

With the object 3 implemented by a photoconductor, the charge potential was determined to be uniform when the discharge was the uniform discharge, but irregular when the discharge was the bright point discharge. Further, when use was made of a charging device as a device for charging a photoconductive element carrying a toner image thereon in order to enhance the adhesion between toner particles and between the toner and the surface of the photoconductive element, the device achieved a sufficient ability if the bright point discharge was reduced to below a certain ratio. Specifically, a sufficient ability was achieved so long as the bright point discharge was rank 3 or above which will be described later.

Conditions for setting up the V-I characteristic represented by the curve A or B will be described hereinafter.

The above V-I characteristic is attainable if, as also shown in FIG. 1, the counter electrode 1 is made up of a metal base 1*b* and a surface layer or film 1*a* formed on the surface of the base 1*b* by plating or frame spraying. The surface layer 1*a* should have a certain degree of resistance because it would obstruct discharge if formed of an insulating material. The curves A and B differ from each other mainly in gradient; the gradient decreases with an increase in the resistance of the surface layer 1*a* and approaches the curve B. If the electrode member 1 has its metal surface exposed, it will show the V-I characteristic represented by the curve C.

Even if the surface layer 1*a* is of the same material as the electrode member 1 showing the characteristic A or B, the V-I characteristic and therefore the discharge condition depends on the thickness and smoothness of the layer 1*a*, as also determined by experiments. For example, when the surface layer 1*a* is too thin, the layer 1*a* has little influence on the V-I characteristic. As a result, the V-I characteristic, like the characteristic C, rises sharply and discontinuously around the discharge start voltage. In light of this, the surface layer 1*a* is provided with a thickness greater than a certain thickness, depending on the specific material of the layer 1.

As the curve B indicates, the gradient of the characteristic curve decreases with an increase in the thickness of the surface layer 1*a*. If the gradient exceeds 1 $\mu$A/V due to the short thickness of the layer 1*a*, sophisticated or difficult adjustment is necessary for the voltage for obtaining a desired discharge current to be set up. Therefore, when the layer 1*a* is formed of a material showing a relatively great gradient like that of the curve A, it is preferable to select a thickness capable of implementing a gradient smaller than 1 $\mu$A/V inclusive. It is to be noted that the gradient of the V-I characteristic relates to the area of the discharging portion; the gradient smaller than 1 $\mu$A/V holds when the discharge area is assumed to be 1 $cm^2$.

To confine the above gradient in the desired range, the resistor 7, FIG. 1, may be used in place of or in addition to the thickness of the surface layer 1*a*. Specifically, when the electrode member 1 shows a characteristic curve having a relatively great gradient like that of the curve A, the gradient and discharge start voltage Vs can be varied if the resistance of the resistor 7 is varied, as also determined by experiments. This is because the resistance of air in the gap g and that of the resistor 7 are combined to reduce the current. Therefore, by adequately selecting the resistance of the resistor 7, it is possible to reduce the gradient to less than 1 $\mu$A/V inclusive. By contrast, when the material of the layer 1*a* shows a characteristic curve whose gradient is as small as that of the curve B, the profile of the V-I characteristic changes little without regard to the presence/absence of the resistor 7. Hence, the resistor 7 is not necessary.

Even when the electrode member 1 has the exposed metal surface showing the characteristic C, it is possible to reduce the current Is and the gradient of the V-I characteristic if the resistor 7 has a resistance higher than 10 MΩ inclusive. When the gradient of the V-I characteristic is reduced, the bright points diminish with the result that the discharge approaches the uniform discharge, as observed by eye. Specifically, if the gradient is less than 1 $\mu$A/V, discharge close to the uniform discharge is attainable by setting a voltage around the discharge start voltage. However, it is impractical to change even the characteristic that the discharge current Is becomes sharp and discontinuous around the discharge start voltage.

Figure 4:
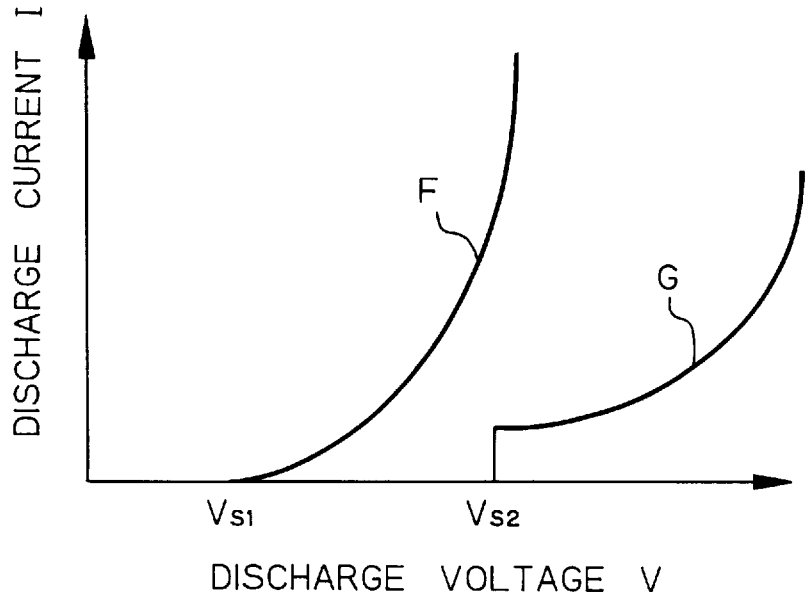
FIG. 4 is a graph showing a relation between the discharge current and the discharge voltage.

The gap g between the object 3 and the electrode member 1 allows discharge to occur easily when it is about 10 $\mu$m. With such a gap it is possible to lower the discharge start voltage of the V-I characteristic, compared to greater gaps g. Conversely, when the electrode member 1 shows the V-I characteristic represented by the curve A or B, increasing the gap g causes the V-I characteristic to vary from a curve F to a curve G shown in FIG. 4, depending on the material (e.g. alunite or sintered metal which will be described later), as also determined by experiments. As a result, the discharge start voltage Vs is shifted, and the discharge current Is becomes sharp and discontinuous around the discharge start voltage Vs. For this reason, the gap g should not be excessively great. The upper limit of the gap g is about 500 $\mu$m although it depends on the material.

Even when the electrode member 1 has the exposed metal surface and shows the V-I characteristic represented by the curve C, the discharge current Is can be smaller when the gap g is about 10 $\mu$m than when it is relatively great. However, even with such a gap, it is impractical to change even the characteristic that the discharge current Is becomes sharp and discontinuous.

The conditions described above allow the uniform discharge to occur with the V-I characteristic represented by the curve A or B. As for the new charging device having the electrode member 1 consisting of the metal base 1*b* and surface layer 1*a*, it is possible to reduce the ratio of the bright point discharge to below a certain degree even if the discharge current Is becomes sharp and discontinuous around the discharge start voltage. This can be done by adequately selecting the gap g and the thickness of the surface layer 1*a*, and by using the resistor 7, as needed.

As stated above, in the illustrative embodiment, the electrode member 1 is formed of a material which prevents, when the voltage applied from the power source 2 to the member 1 reaches the discharge start voltage, the current flowing toward the object 3 from becoming sharp or discontinuous. The member 1 therefore prevents the bright point discharge from occurring between it and the object 3. This makes it possible to control the small discharge current tending to become unstable around the discharge start voltage, and thereby sets up uniform discharge between the member 1 and the object 3. Consequently, the object 3 can be uniformly charged. Further, if the gap g and the thickness of the surface layer 1*a* are adequately selected with or without the resistor 7, and if the ratio of the bright point discharge is reduced to below a certain degree, the electrode member 1 with the surface layer 1*a* formed by plating or frame spraying implements a charging device having a sufficient ability as the previously mentioned toner image charging device or similar charging device accommodating a certain degree of irregular charging.

Specific examples of the illustrative embodiment will be described hereinafter. In a first example, the electrode member 1 has a metal base 1*b* made of aluminum, and the surface layer formed on the surface of the base 1*b* facing the body 3 and made of hard alunite. The hard alunite layer 1*a* may be formed by the following procedure. First, the base or aluminum 1*b* is subjected to grease removal, etching and rinsing, and then immersed in an electrolyte (oxalic acid, sulfuric acid or chromic acid or a dillution of their mixture) for anodic oxidation. Subsequently, the base 1*b* is rinsed and then subjected, if necessary, to sealing using hot water, vapor under pressure, or nickel acetate. Finally, the base 1*b* is again rinsed with water or hot water and then dried.

The charging device with the electrode member having the hard alunite layer 1*a* has a V-I characteristic represented by the curve A or B shown in FIG. 2. The curves A and B respectively hold when the hard alunite layer 1*a* is relatively thin and when it is relatively thick. With this charging device, uniform discharge was observed by eye over the entire gap, and data equivalent to the data D of FIG. 3 was attained. When the charging device was applied to an image forming apparatus, a charge potential free from irregularity was achieved.

Even the hard alunite layer 1*a* implementing the uniform charge sometimes comes off the aluminum base 1*b* after several hours of discharge. This is because if the layer 1*a* is thin, mechanical strains occur between the base 1*b* and the layer 1*a* and cause the layer 1*a* to crack. The cracks occur during or after the formation of the layer 1*a*. Experiments showed that the layer 1*a* often comes off the base 1*b* between the cracks. It was found that when the thickness of the layer 1*a* is increased, the cracks are reduced or disappear halfway or branch. Reducing the cracks of the layer 1*a* directly translates into reducing the separation of the hard alunite layer 1*a* and aluminum base 1*b* ascribable to discharge.

Figure 5:
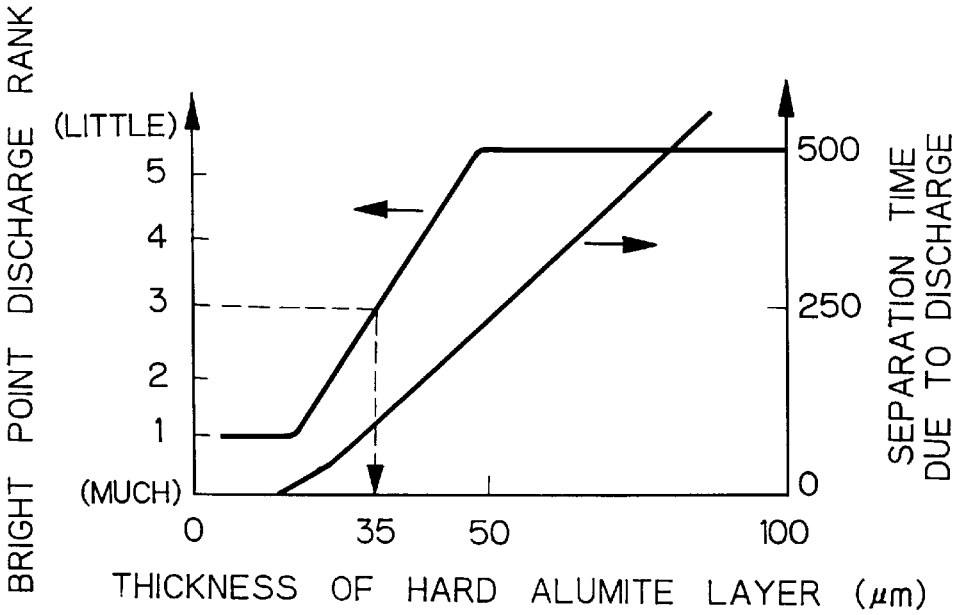
FIG. 5 is a graph showing a relation between the thickness of a hard alunite layer formed on an electrode member, the rank of bright point discharge, and the time in which the hard alunite layer comes off due to discharge.

FIG. 5 shows a relation between the thickness of the hard alunite layer 1*a*, the condition of bright point discharge (left ordinate), and the period of time in which the layer 1*a* comes off the base 1*b* (right ordinate). In FIG. 5, the condition of bright point discharge is shown in five consecutive ranks. Some different conditions exist for determining the thickness of the layer 1*a*. For example, rank 3 and higher ranks allow the body 3, e.g., photoconductive element to be uniformly charged while rank 5 allows the uniform discharge to be set up. The thickness of the layer 1*a* may be determined on the basis of a preselected target period of time, e.g., 250 hours. To thin the layer 1*a* as far as possible, the thickness is so selected as to confine the condition of the bright point discharge in rank 3. Although such a thickness reduces the period of time in which the layer 1*a* comes off due to discharge, it can be extended if the electrode member 1 is implemented as a roller, as will be described later. This is because the electrode member 1 in the form of a roller is rotatable and prevents its same portion from contributing to discharge continuously.

As FIG. 5 indicates, the condition of the bright point discharge can be held in rank 3 if the hard alunite layer 1*a* is 35 μm thick or above. With this thickness, it is also possible to reduce the number of cracks penetrating throughout the layer 1*a* in the direction of thickness.

The upper limit of the thickness of the hard alunite layer 1*a* must be selected in consideration of period of time for forming the layer 1*a* on the base 1*b*. Further, as for the hard alunite layer 1*a* suitable for the first example, the temperature of the liquid for anodic oxidation and the current density are additional factors. Preferably, the liquid temperature should be 5° C. or below while the current density should be low, so that the layer 1*a* can grow slowly. The slow growth of the layer 1*a* further enhances the uniform discharge and the protection of the layer 1*a* from separation.

Figure 6:
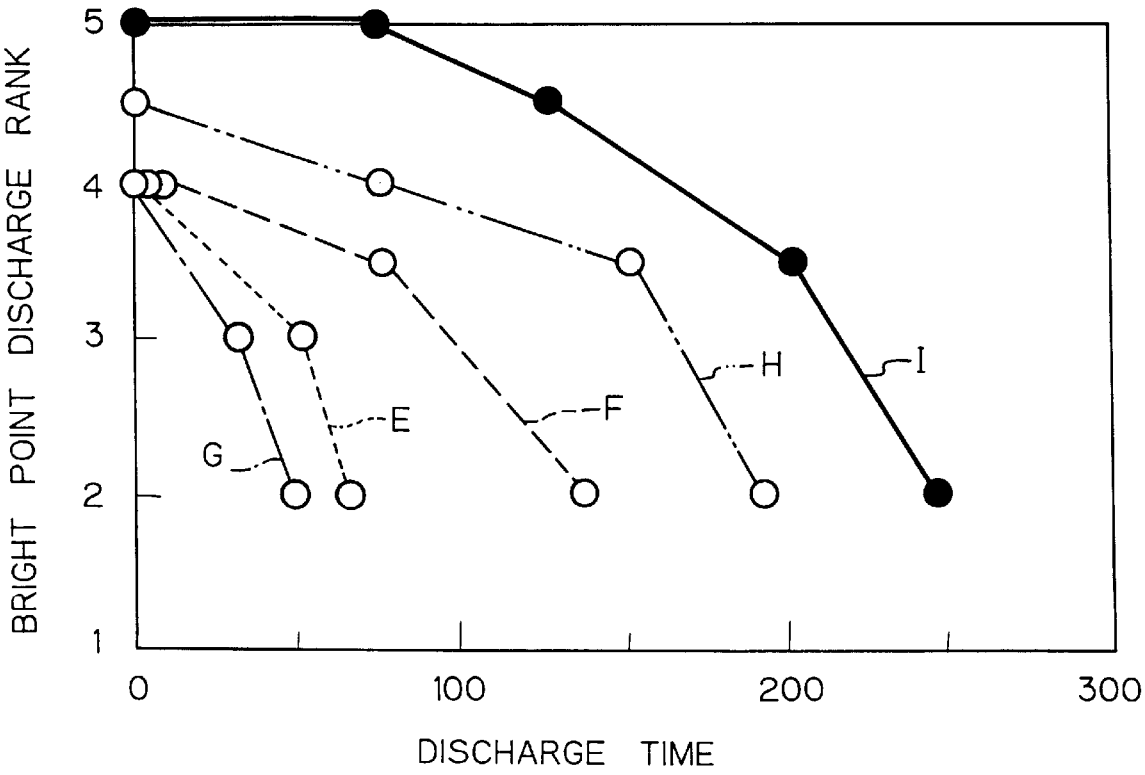
FIG. 6 is a graph showing a relation between a discharge time and the rank of bright point discharge.

Samples E–I were each formed with the hard alunite layer 1*a* at a particular sulfuric acid bath temperature and a particular current density, as listed in Table 1 below. FIG. 6 shows the variations of the ranks of the bright point discharge with respect to time and determined with the above samples E–I. As FIG. 6 also indicates, the sample I with the liquid temperature of 5° C. can realize rank 5 and maintain rank 3 or higher rank for about 200 hours since the start of discharge, and the rank becomes high and the period of time for which desirable ranks are maintained extends with the fall of the temperature. The samples E–I were 45 μm thick each and formed by use of aluminum A1050 (pure aluminum) and a sulfuric acid bath with a concentration of 15 wt %.

TABLE 1

| SAMPLE | E | F | G | H | I |
|---|---|---|---|---|---|
| SULFURIC ACID BATH TEMP (°C.) | 21 | 10 | 10 | 10 | 5 |
| CURRENT DENSITY ($A/dm^2$) | 2 | 2 | 3 | 1 | 1 |

It will be seen that the hard alunite layer 1*a* should preferably be 35 μm thick or above in order to maintain rank 3 and higher ranks, but it should be 100 μm or below in consideration of productivity taking account of the period of time for the formation of the layer 1*a*. With such ranks, the discharging device can exhibit its ability as the toner image charging device. More preferably, the thickness should be between 50 μm and 80 μm. The thickness of about 50 μm or above ensures rank 5 and higher ranks and thereby implements even a charging device for charging the photoconductive element uniformly.

As stated above, in the first example, the hard alunite layer 1*a* is formed on the surface of the aluminum base 1*b* that faces the body 3. The electrode member 1 with such a configuration achieves such a V-I characteristic that when the voltage applied from the power source 2 to the member 1 reaches the discharge start voltage, the discharge current Is flowing between the member 1 and the object 3 is prevented from varying sharply and discontinuously. This ensures uniform discharge free from bright point discharge between the electrode member 1 and the object 3 and thereby ensures the uniform charging of the object 3. Further, it is possible to control the small discharge current because the variation of the discharge current for a unit variation of the voltage (gradient of the V-I characteristic) decreases when the voltage applied to the electrode member 1 is higher than the discharge start voltage Vs.

Moreover, the hard alunite layer 1*a* has a thickness of greater than 35 $\mu$m inclusive. Under a discharge field strength for ordinary charge, discharge, image transfer or the like effected in an image forming apparatus, the above thickness reduces mechanical strains to occur between the base 1*b* and the hard alunite layer 1*a* due to aging. This prevents cracks from growing throughout the layer 1*a* in the direction of thickness and causing the layer 1*a* from coming off the base 1*b*. As a result, not only the uniform discharge is further stabilized, but also the life of the electrode member 1 is extended.

In a second example of the first embodiment, the surface layer 1*a* formed on the surface of the metal base 1*b* is implemented as a film of porous sintered metal. To form the film of porous sintered metal, there may advantageously used flame spraying, e.g., gas spraying, self-meltable alloy spraying, plasma spraying or jet coat spraying capable of forming a film having a particular characteristic.

Figure 7:
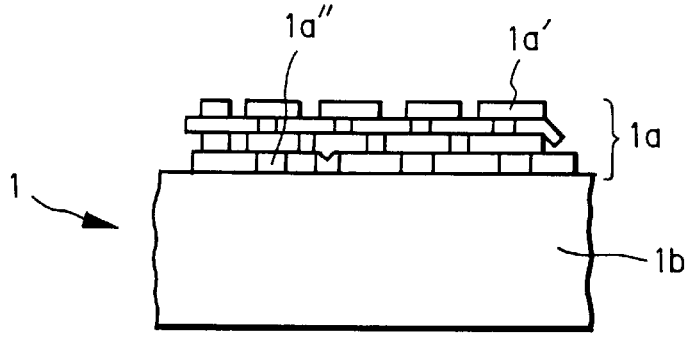
FIG. 7 is a model showing a sintered metal layer formed on the surface of the electrode member.

FIG. 7 is a model of the sintered metal layer 1*a*. As shown, the layer 1*a* consists of flat particles 1*a* stacked in a laminate structure and spaced from each other by irregular air cells or pores 1*a*". The pores 1*a*" are not communicated in the direction of thickness of the layer 1*a*. The pores 1*a*" are sized 10 angstroms to several $\mu$m each, so that the uppermost layer is porous. Therefore, at the time of discharge, the layer 1*a* presumably increases the surface area of the electrode member 1 and prevents the electric field from concentrating to an extreme degree.

The porous structure depends on the frame spraying condition and is defined in terms of porosity. Porosity is the ratio of the pores to the sprayed metal. When the porosity is 5% to 10%, deterioration ascribable to discharge, i.e., the separation of the sintered metal film is likely to occur. The porosity range promoting the uniform discharge is also 5% to less than 10% inclusive; presumably, the electric field is locally concentrated. As for the lower limit of porosity, deterioration ascribable to the discharge does not occur up to 0.1% for production reasons. Preferably, therefore, the porosity should be between 0.1% and 5%.

The sintered metal film satisfying the characteristic A or B should have an adequate resistance and is determined by the metal constituting the film. For example, when only $Al_2O_3$ is sprayed to form a sintered metal film which is less than 0.2 mm thick inclusive, it brings about the bright point discharge. Further, when the $Al_2O_3$ film is about 0.5 mm thick, it prevents discharge from occurring. Therefore, $Al_2O_3$ is not feasible for the uniform discharge alone. However, when use is made of a sintered metal including $Al_2O_3$ as its main constituent for plasma spraying, even $Al_2O_3$ will be feasible for the uniform discharge, depending on the material to be mixed therewith, as follows.

$Al_2O_3$—$TiO_2$ is one of the mixtures feasible for the uniform discharge. Specifically, when the content of $TiO_2$ in $Al_2O_3$—$TiO_2$ was varied from 50 wt % to 5 wt %, the mixture sequentially showed the characteristics C, A and B, FIG. 2, in this order and finally caused substantially no discharge to occur. Also, when the $Al_2O_3$—$TiO_2$ containing 10 wt % to 20 wt % of $TiO_2$ was plasma-sprayed to form a 0.2 mm to 0.5 mm thick sintered metal film on a metal base, the uniform charge with the characteristic A or B was easily achieved. Initially, the sintered metal film was formed by plasma spraying to a thickness 20 $\mu$m to 100 $\mu$m greater than the target thickness. Then, the film was ground to form a smooth surface. Subsequently, the film was rinsed and then subjected to heat treatment to complete an electrode member feasible for the uniform discharge.

Another suitable mixture is $Al_2O_3$—$Cr_2O_3$. When $Al_2O_3$—$Cr_2O_3$ mixture containing 20 wt % to 20 wt % of $Cr_2O_3$ was plasma-sprayed to form a 200 $\mu$m to 500 $\mu$m thick film on a metal base, the uniform discharge was also easily achieved.

For the metal base to which any one of the above mixtures is plasma-sprayed, use may be made of aluminum, stainless steel, iron or the like in matching relation to the configuration of the electrode member.

Figure 8:
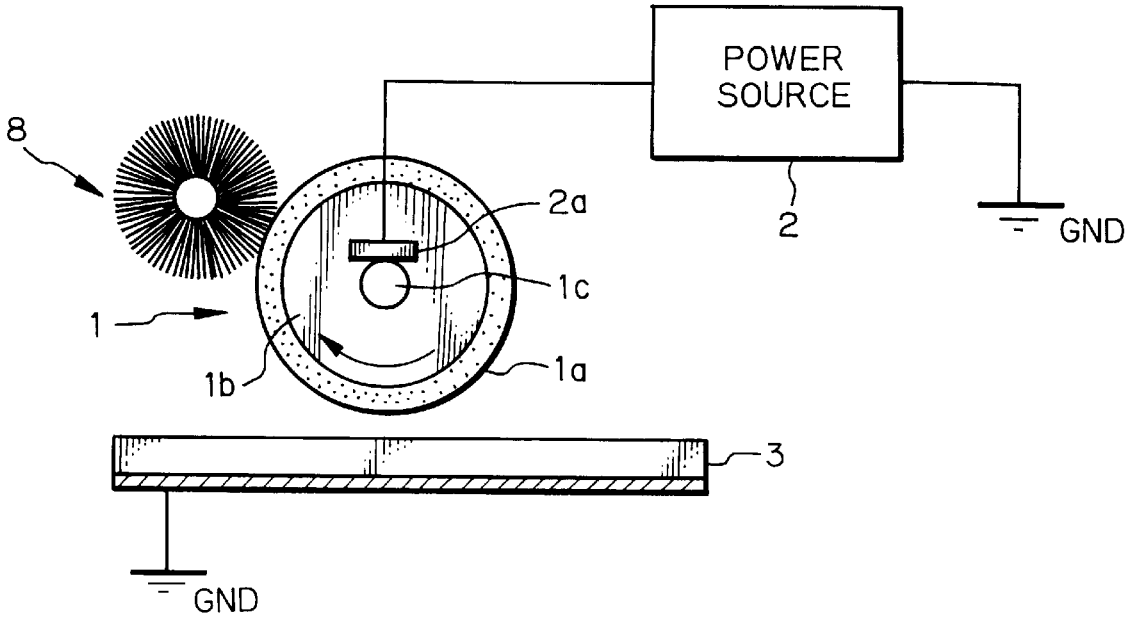
FIG. 8 is a section showing a specific example of the first embodiment.

As shown in FIG. 8, in a third example of the first embodiment, the electrode member 1 is implemented as a roller having a surface movable endlessly. The electrode member or roller 1 is driven by drive means, not shown, to rotate about its shaft 1*c* while being spaced from the object 3. The output voltage of the power source 2 is applied to the roller 1 via, e.g., a brush-like electrode terminal 2*a* slidably contacting the shaft 1*c*. That the surface of the roller 1 facing the object 3 moves means that the same portion of the roller 1 does not continuously face the object 3. Therefore, the surface layer 1*a* implemented by hard alunite or sintered metal suffers from a minimum of crack or similar defect, further enhancing the uniform discharge. Further, the life of the electrode member 1 is extended. In addition, although the surface of the electrode member 1 may be locally deteriorated due to the deposition of precipitates ascribable to discharge, the deteriorated or uneven portion faces the body 3 only for a short period of time. This further promotes the stable uniform discharge.

In FIG. 8, a brush-like contact member 8 contacts the surface of the electrode member 1 either constantly or intermittently. In the event of discharge, the contact member 8 removes impurities and products derived from discharge from the surface of the electrode member 1, so that the uniform discharge condition can be maintained over a long period of time. If the contact member 8 is formed of a conductive material, it should be provided with a structure preventing the voltage applied to the electrode member 1 from causing discharge to the other portions, e.g., a floating structure.

Figure 9:
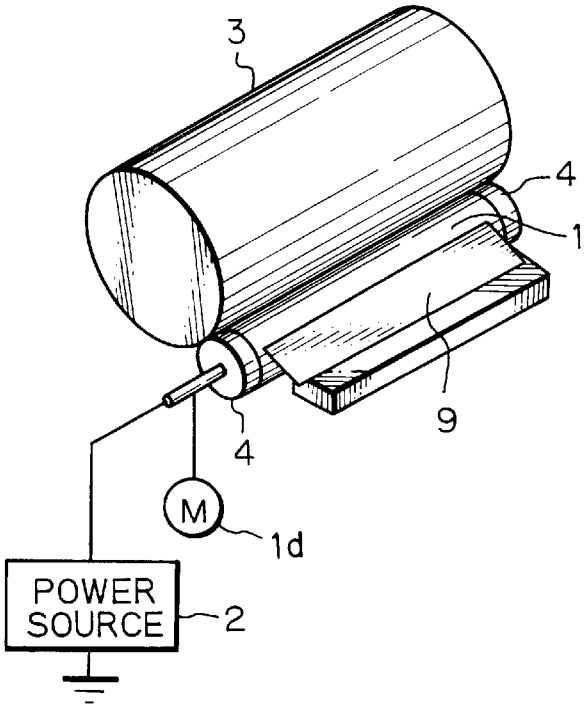
FIG. 9 is a perspective view showing another specific example of the first embodiment.

FIG. 9 shows another specific arrangement in which the roller 1 is rotatable without contacting the object 3. As shown, spacers 4 are mounted on opposite ends of the roller 1, and each has a greater diameter than the roller 1. The spacers 4 are held in contact with the surface of the object 3 which is implemented as a drum. This forms a gap between the surface of the roller 1 and that of the drum 3. The contact member 8 is implemented as a scraper 9 contacting the roller 1 and provided with, e.g., the above-mentioned floating structure.

Figure 10:
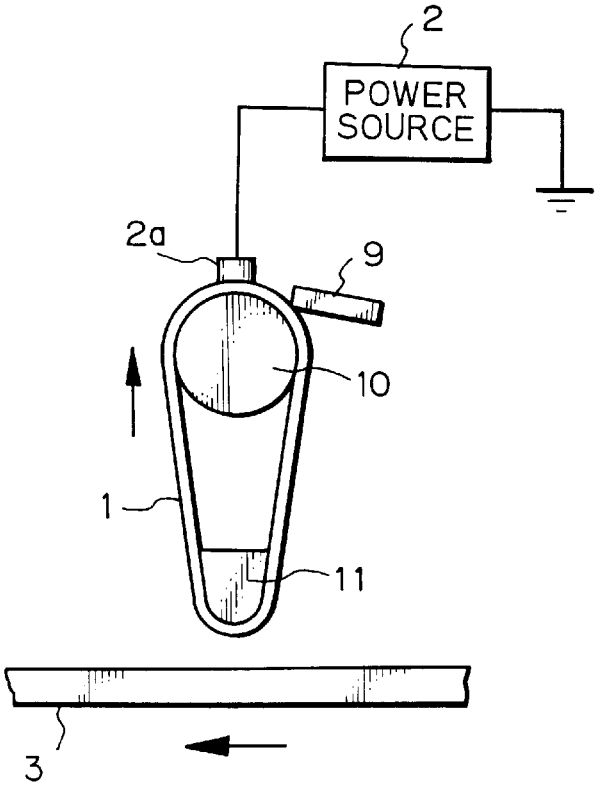
FIG. 10 is a section showing still another specific example of the first embodiment.

As shown in FIG. 10, in a fourth example of the first embodiment, the electrode member 1 is implemented as a belt or sheet having a surface movable endlessly relative to the object 3. The power source 2 applies a voltage to the belt 1 via a brush-like electrode 2*a*. The belt 1 is passed over an upper support or roller 10 and a lower support 11 adjoining the body 3 and is spaced from the object 3. The belt 1 is driven by the upper support or drive roller 10 in a direction indicated by an arrow in FIG. 10. The scraper or similar contact member 9 is held in contact with the belt 1 in order to remove impurities from the belt 1. The contact member 9 is electrically independent of the other members. To promote desirable discharge, an insulating cover, not shown, should preferably be provided around the belt 1.

Figure 11:
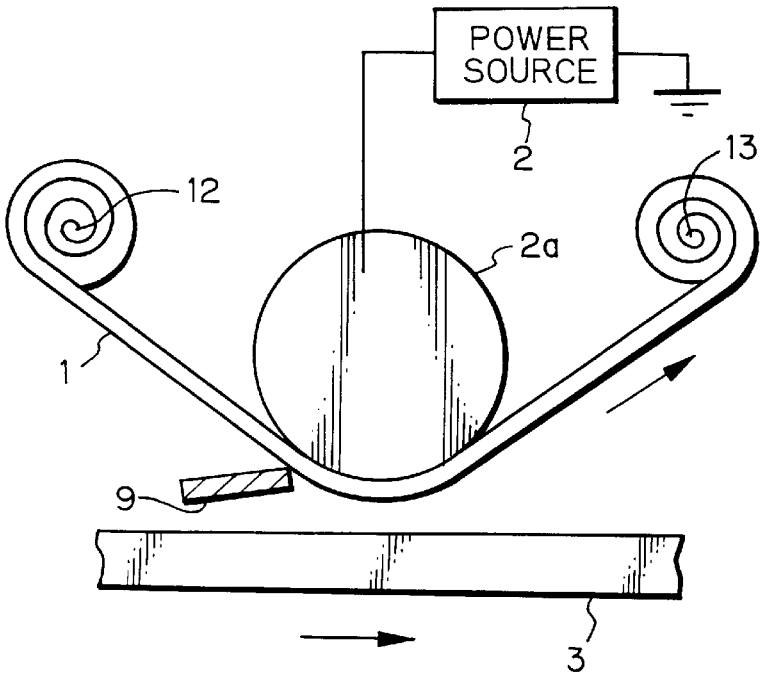
FIG. 11 is a further specific example of the first embodiment.

As shown in FIG. 11, in a fifth example of the first embodiment, the electrode member 1 is implemented as a sheet or webbing. The electrode terminal 2*a* is implemented as a roller causing a part of the webbing 1 to face the object 3 while being spaced from the object 3. In this sense, the roller 2*a* plays the role of a back-up member at the same time. The power source 2 is connected to the electrode terminal 2*a*. The webbing 1 is paid out from a feed shaft 12 and taken up by a take-up shaft 13. While the webbing 1 is taken up by the take-up shaft 13, its surface moves relative to the body 3 in a direction indicated by an arrow in FIG. 11. The take-up of the webbing 1 may be effected or not effected during charging, as desired. Again, the scraper or similar contact member 9 is held in contact with the webbing 1 and electrically independent of the other members.

The electrode member 1 shown in FIG. 10 or 11 should be in the form of a belt or a sheet and should be flexible. Even the electrode member 1 with the surface layer 1*a* formed of hard alunite or sintered metal may be provided with such a belt- or sheet-like configuration and be made flexible, depending on, e.g., the thickness of the base 1*b*.

While the first embodiment has concentrated on a charging device included in an image forming apparatus, it is similarly applicable to a discharging device, image transferring device or the like also included in the above apparatus and using discharge. Also, the embodiment may be implemented as a discharging device used to improve the wettability and other surface properties of various kinds of materials.

2nd Embodiment

Figure 12:
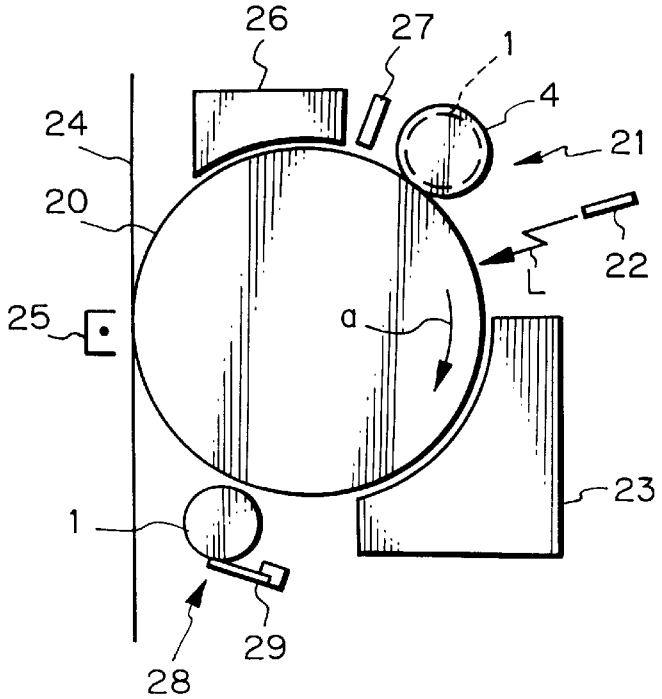
FIG. 12 is a section of a copier representative of a second embodiment of the present invention.

An embodiment to be described is applied to an electrophotographic copier or simply copier as referred to hereinafter. As shown in FIG. 12, the copier includes a photoconductive drum or image carrier 20 rotatable at a constant speed in a direction indicated by an arrow a. A charging unit 21 implemented by a discharge electric field forming device charges the surface of the drum 20 uniformly. A laser scanner or similar exposing device 22 focuses a light image L onto the charged surface of the drum 20 and thereby electrostatically forms a latent image thereon. The charging unit 21 and exposing device 22 constitute latent image forming means. Then, an eraser, not shown, discharges the area of the drum 20 other than the image forming area. A developing unit 23 stores a developing liquid consisting of liquid carrier and toner dispersed thereon. When the latent image formed on the drum 20 is brought to a position where the drum 20 faces the developing unit 23, the unit 23 develops it with the developing liquid and thereby forms a corresponding toner image.

A paper or similar recording medium 24 is fed from a paper feed device, not shown, to a position where an image transferring unit 25 faces the drum 20. After the image transfer unit has transferred the toner image from the drum 20 to the paper 24, the paper 24 is separated from the drum 20. A cleaning unit 26 includes a cleaning blade for removing the toner left on the drum 20 after the image transfer. Subsequently, a quenching lamp or discharge lamp 27 removes potentials also left on the drum 20 after the image transfer, thereby preparing the drum 20 for the next copying cycle.

In the illustrative embodiment, a toner image charging device 28 is positioned between the developing unit 23 and the image transferring unit 25. The charging device 28 causes discharge to occur between it and the drum 20 carrying the toner image, thereby depositing charge on the toner image. The charge deposited on the toner image increases the adhesion between the particles of the toner and between the toner and the surface of the drum 20. This successfully prevents the toner from flying away from the drum 20 and disfiguring the toner image. In addition, the above charge prevents the toner image from being separated into pieces due to the condensation of the developing liquid.

The charging unit 21 may be implemented by the discharge electric field forming device of the first embodiment. Because the electric field forming device has the electrode member 1 spaced from an object to be discharged, it may even be used as the toner image charging device 28. The charging unit 21, for example, has the electrode member or roller 1 with the spacers 4 mounted on opposite ends thereof, a power source, not shown, for applying a voltage to the member 1, and a drive source, not shown, for causing the member 1 to rotate. The toner image charging device 28 has the electrode member or roller 1 facing, but not contacting, the drum 20 at a position between the developing unit 23 an the image transferring unit 25. A power source, not shown, applies a voltage to the electrode member. A drive source, not shown causes the electrode member 1 to rotate. A scraper or similar contact member 29 is held in contact with the surface of the electrode member 1 of the charging device 28. The charging unit 21 and toner image charging device 28 each consists of an aluminum base and a surface layer of hard alunite or sintered metal, as in the first embodiment. If desired, the charging device of the first embodiment may be applied to only one of the charging unit 21 and charging device 28. Further, the charging device of the first embodiment may be applied to the image transferring unit 25.

The second embodiment with the charging unit 21 and/or the charging device 28 implemented by the first embodiment is capable of forming attractive images based on the uniform charge. Although the embodiment has concentrated on a copier using a developing liquid, it is practicable even with a developer using a dry developer.

3rd Embodiment

This embodiment is applicable to an electrophotographic copier of the type using a developing liquid and transferring, after causing a toner image charging device to cause a toner image to cohere, causing an image transferring device to transfer the toner image to a recording medium. This embodiment is characterized in that the image transferring device deposits charge which is 20% to 100% of the charge to be deposited by the toner image charging device.

Figure 13:
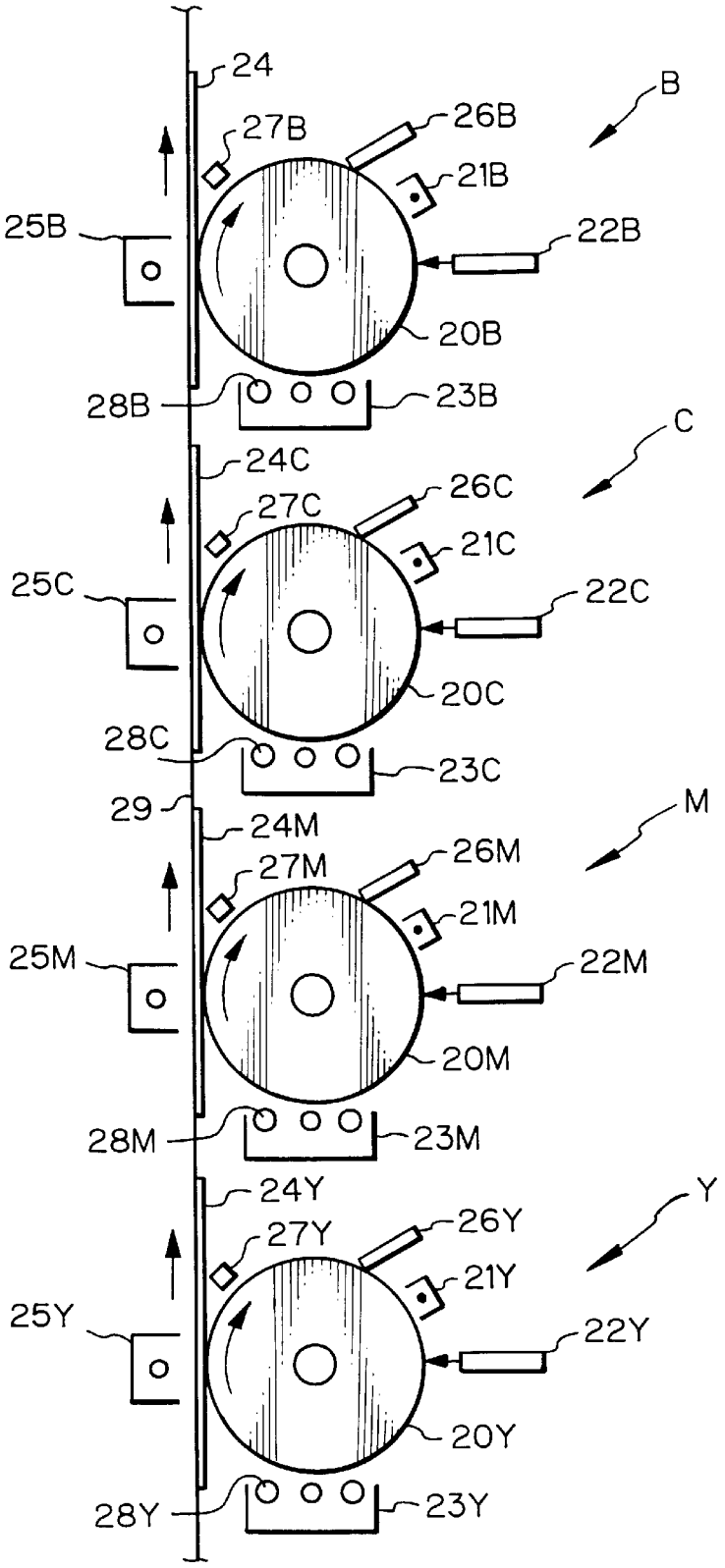
FIG. 13 is a fragmentary section of an image forming apparatus using a developing liquid and representative of a third embodiment of the present invention.

As shown in FIG. 13, an image forming section included in the above type of copier has a conveying unit including a transfer belt 29. The conveying unit conveys the recording medium or paper 24 upward with the transfer belt 29. A yellow toner image forming unit Y, a magenta toner image forming unit M, a cyan toner image forming unit C and a black toner image forming unit B are sequentially arranged along the belt 29. Because the construction and operation of these units Y, M, C and B are identical except for the color of toner, let the following description concentrate on the yellow toner image forming unit Y by way of example.

The toner image forming unit Y includes a photoconductive drum or image carrier 20Y. Arranged around the drum 20Y are a charging device and an exposing device for forming a latent image on the drum 20Y, a developing device or means for developing the latent image, an image transferring device or means, a discharging device, and a cleaning device. The developing device stores the previously mentioned carrier and toner mixture liquid. The charging device is implemented as a transfer charger for causing toner particles to move from the drum Y to the paper 24 by electrophoresis and electrostatically deposit thereon.

Specifically, the developing device, labeled 23Y, has a developing roller, a squeeze roller, and a toner image charging device 28Y sequentially arranged in the order of step. The developing roller forms a toner image by causing the developing liquid to contact the latent image formed on the drum 20Y: The squeeze roller removes a needless portion of the liquid carrier after the formation of the toner image. The toner image charging device 28Y deposits charge on the toner image for thereby increasing the adhesion.

Figure 14:
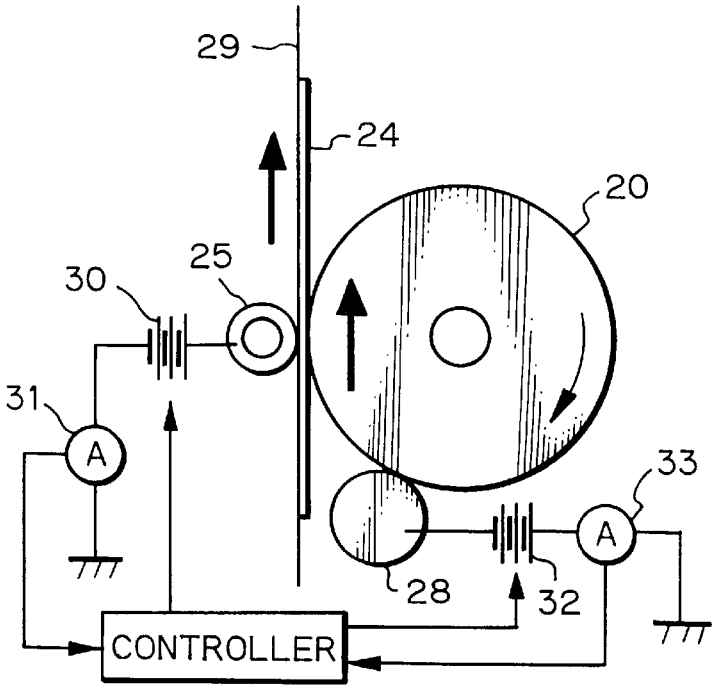
FIGS. 14, 15, 16 and 17 are fragmentary sections each showing a specific configuration of the third embodiment.

FIG. 14 shows a first specific configuration of the third embodiment. As shown, in the copier of the type causing the toner image charging device (set roller 28) to cause a toner image formed on the drum 20 by the above procedure to cohere and then transferring the image from the drum 20 to the paper 24, the specific configuration is characterized in that the charge for image transfer is selected to be 20% to 100% of the charge to be deposited by the toner image charging device.

As shown in FIG. 14, the transfer belt 29 runs in contact with the drum 20 in a direction indicated by an arrow. A transfer charge roller 25 is rotatably located at a position where the belt 29 contacts the drum 20. A power source 30 applies a bias current (transfer charge) for image transfer to the charge roller 25. A current monitor 31 senses the bias current. A toner image charging device is implemented as a conductive roller 28 positioned upstream of the image transfer position and spaced from the surface of the drum 20. A power source 32 feeds a current to the conductive roller 28 while a current monitor 33 senses the current.

When the belt 29 brings the paper 24 to the image transfer position of the drum 20, the transferring device 25 applies a bias opposite in polarity to the toner to the rear of the paper 24. As a result, the toner image is transferred from the drum 20 to the paper 24.

In the copier of the type using the toner image charging device, the amount of charge necessary for image transfer depends on the amount of charge deposited on the toner by the toner image charging device. Specifically, if the charge for image transfer is small relative to the charge for toner image charging, then the image transfer is short; if the former is great relative to the latter, then the image transfer is disturbed due to, e.g., the transition of the toner polarity. This is why the first specific configuration selects the charge for image transfer which is 20% to 100% of the charge for charging the toner image. Experiments showed that the above range of image transfer charger ensures desirable image transfer. It is to be noted that any desired ratio between 20% and 100% can be selected, depending on the insulation of the developing liquid, image forming conditions, the characteristic of the photoconductor, and the electric characteristic of the paper.

The conductive roller 28 may be disposed in the developing device, as shown in FIG. 13, or may be located downstream of, but in close proximity to, the developing device. The present invention, including other specific configurations thereof to be described, is practicable with any of such different conditions.

A second specific configuration of the third embodiment is similar to the first configuration except that the current monitor 33, FIG. 14, monitors the current flowing through the conductive roller 28. Specifically, in the image forming section including the toner image charging device 28, it sometimes occurs that the gap between the drum 20 and the conductive roller or toner image charging device 28 varies every moment due to the irregular dimensional accuracies of the drum 20, charge roller 28, bearings, etc. Moreover, the above gap sometimes varies due to wear ascribable to a long time of operation. It was found that the varying gap between the drum 20 and the roller 28 causes the current of the charging device 28 to vary, resulting in unstable image quality.

In light of the above, the current monitor 33 monitors the current being fed from the toner image charging device 28 on a real-time basis. Current information for optimally controlling the transfer current of the image transferring device 25 is generated on the basis of the monitored current. The current to be fed to the device 25, i.e., the output of the power source 30 is controlled on the basis of such current information. Therefore, it is possible to execute real-time control over the image transfer charge flexibly in accordance with the variation of the current of the toner image charging device 28. Further, data for correcting the output of the charging device 28 is computed on the basis of the real-time current value of the device 28 and fed back to the power source 32. As a result, the output of the power source 32 is so controlled as to further stabilize the charge for toner image charging, i.e., the image transfer.

A third specific configuration of the third embodiment is characterized in that, in FIG. 14, the current monitor 31 monitors the current flowing through the image transferring device 25. It is likely that the device 25 is contaminated by, e.g., the developing liquid and paper dust deposited on the charging device and transfer belt. The contamination of the device 25 causes the current of the device 25 to vary, deteriorating image transfer. To solve this problem, in the third specific configuration, the current monitor 31 monitors the current being fed from the power source 30 to the device 25 on a real-time basis. This allows error information to be generated instantaneously and thereby allows a report meant for the operator or a transfer member clean command to be output. This further stabilizes the image transfer.

In all the specific configurations described above, the toner image charging device 28 is implemented as a conductive roller. The roller 28 may be formed of metal or similar suitable material. What is advantageous with the conductive roller is that a scraper or similar cleaning means can be held in sliding contact with the roller in order to protect it from contamination. If desired, a high resistance film, hard film or similar protection film may be formed on the roller 28.

Figure 15:
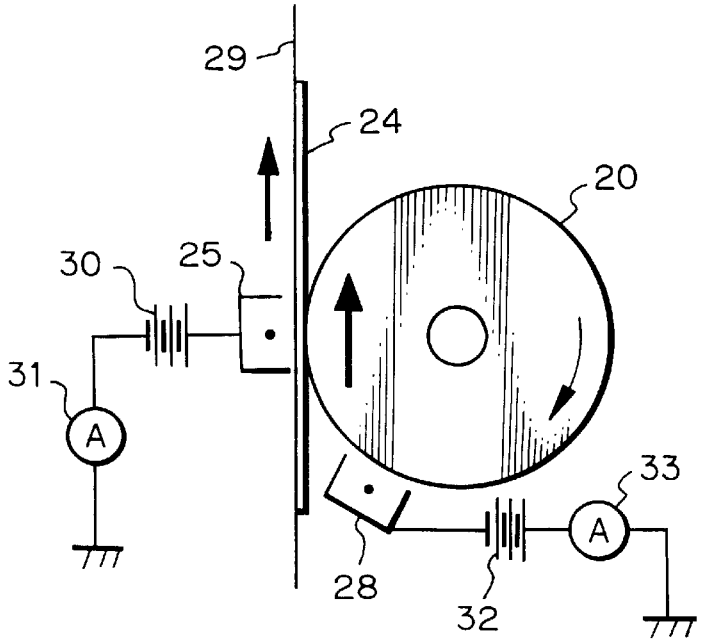

FIG. 15 shows a fourth specific configuration in which the toner image charging device 28 is implemented as a corona charger having a charge wire. The corona charger is advantageous in that the uniform charge is achievable with ease. The amount of current may be monitored in terms of the total current of the charge wire and the current of a casing. As to the rest of the construction, operation and control, this specific configuration is identical with the first to third configurations.

Figure 16:
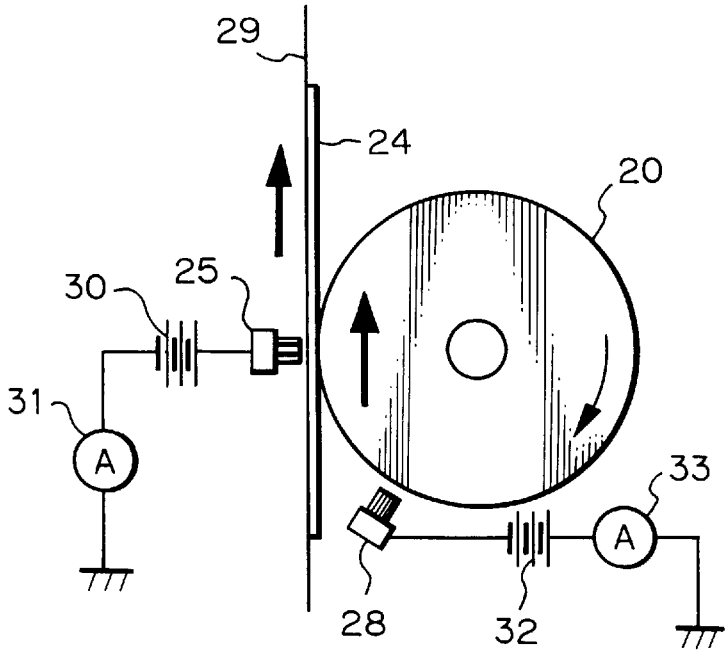

FIG. 16 shows a fifth specific configuration characterized in that the toner image charging device 28 in the form of a conductive brush is used. As for the rest of the construction, operation and control, this configuration is also identical with the first to third configurations.

The image transferring device 25 may use the conductive roller shown in FIG. 14. The conductive roller may be formed of metal, conductive rubber, conductive urethane or similar conductive material. What is advantageous with the conductive roller is that because charge is deposited at a gap upstream of the nip, it is easy to define the charge depositing position. If desired, a high resistance film, hard film or similar protection film may be formed on the roller 25. As to the rest of the construction, operation and control, this configuration is identical with the first to third configurations.

Alternatively, the image transferring device 25 may use the corona charger with the charge wire shown in FIG. 15. The advantage of the corona charger has already been described. As to the rest of the construction, operation and control, this configuration is also identical with the first to third configurations. Further, the device 25 may be implemented by the conductive brush shown in FIG. 16.

Figure 17:
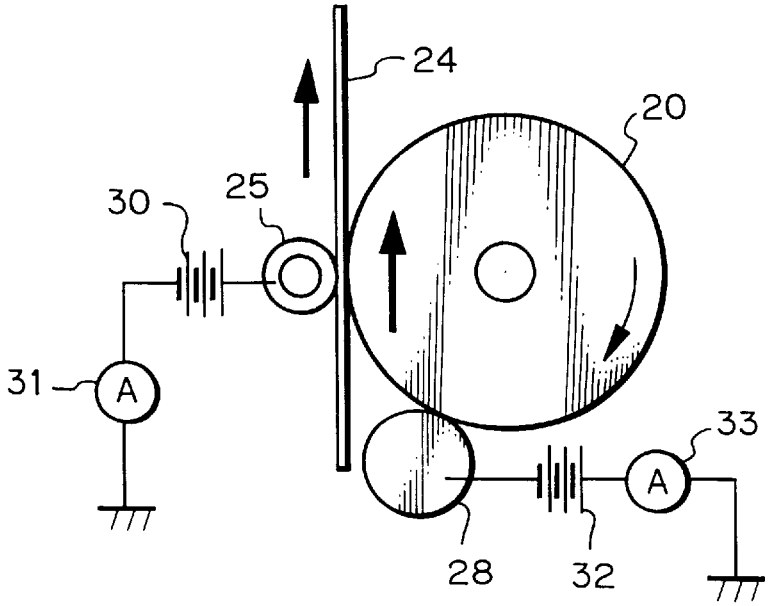

FIG. 17 shows a sixth specific configuration which does not use the transfer belt 29. The advantage of this kind of configuration is that a desired amount of charge is achievable with a relatively low image transfer voltage because a voltage fall ascribable to the resistance of the belt 29 does not occur. While both the image transferring device 25 and the toner image charging device 28 in FIG. 17 are implemented as rollers, the configuration lacking the belt 29 may be applied to FIG. 15 or 16. As to the rest of the construction, operation and control, this configuration is also identical with the first to third configurations.

In any one of the configurations including the transfer belt 29, the belt 29 may be formed of a material having a medium resistance (10E8 $\Omega c\ m^2$ to 10E12 $\Omega c\ m^2$). With such a belt 29, it is possible to reduce the voltage drop ascribable to the resistance of the belt as well as the contamination of the image transferring device by the liquid.

Also, in any one of the above configurations, the transfer belt 29 may be formed of a material having a high resistance (10E14 $\Omega c\ m^2$ or above). This guarantees the adhesion of the paper due to electrostatic charge remaining on the belt and thereby promotes stable paper conveyance.

When use is made of the conductive roller, corona charger or brush as the image transferring device, it may be combined with the toner image charging device 28 shown in FIG. 14, 15 or 16, as stated above. However, this is only illustrative and may be replaced by any other suitable combination of the image transferring device and the toner image forming device 28. For example, the conductive roller serving as the transferring device may be combined with the corona charger or the brush serving as the charging device. Further, the transfer charger may be combined with the conductive roller or the brush. All such combinations can be constructed, operated and controlled in the same manner as in the first, second or third specific configuration.

In summary, it will be seen that the present invention provides an image forming apparatus having various unprecedented advantages, as enumerated below.

(1) When a voltage applied from a power source to an electrode member reaches a discharge start voltage, a discharge current to flow between the electrode member and an object to be discharged does not change sharply or discontinuously. This frees the discharge from bright point discharge and thereby ensures uniform charge, uniform discharge and uniform image transfer.

(2) Because the bright point discharge does not occur around the discharge start voltage, the uniform discharge corresponding to the voltage around the discharge start voltage can be effected for, e.g., uniform charging. It follows that charging is available based on discharge using a relatively small discharge current which corresponds to the voltage around the discharge start voltage.

(3) An electrode member has a base formed of aluminum, and a hard alunite layer formed on the surface of the base facing the object. Therefore, when the voltage applied from the power source to the electrode member reaches the discharge start voltage, a discharge current to flow between the electrode member and the object does not change sharply or discontinuously. This also frees the discharge from bright point discharge and thereby ensures discharge close to the uniform discharge. Further, in a range wherein the voltage applied to the electrode member is higher than the discharge start voltage, the variation of the discharge current for a unit variation of the voltage can be reduced. Moreover, when the hard alunite layer is 35 $\mu$m thick or above, mechanical strains to act between the aluminum base and the hard alunite layer due to aging are reduced under the conditions of a discharge electric field strength conventional with charging, discharging or image transfer in an image forming apparatus. The above conditions include, e.g., a gap of 10 $\mu$m to 100 $\mu$m between the electrode member and the body, and a voltage of 1,200 V to 1,300 V. The decrease in mechanical strain eliminates cracks otherwise extending throughout the hard alunite layer in the direction of thickness and causing the layer to come off the base. Consequently, not only the uniform or substantially uniform discharge is stably maintained, but also the life of the electrode member is extended.

(4) The surface layer of the electrode member is implemented by porous sintered metal. This, coupled with the fact that the thickness and porosity of the surface layer are each confined in a particular range, allows the surface of the electrode member facing the object to have an area suitable for the uniform discharge. As a result, the electric field is prevented from locally concentrating to an extreme degree. When the voltage applied to the electrode member reaches the discharge start voltage, the uniform discharge with a minimum of bright point discharge is attainable.

(5) The porous sintered metal constituting the surface of the electrode member is rigid enough against mechanical impacts and highly durable.

(6) The porous sintered metal layer can be easily formed by plasma spraying.

(7) When the material for plasma spraying is sintered metal whose major component is $Al_2O_3$, the resistance of the sintered metal can be maintained high. Therefore, if $Al_2O_3$ is combined with another material, it is possible to control the resistance of the sintered metal so as to ensure the uniform discharge.

(8) Assume that the material for plasma spraying is $Al_2O_3$—$TiO_2$ or $Al_2O_3$—$Cr_2O_3$. Then, by changing the content of $TiO_2$ or that of $Cr_2O_3$ in terms of wt %, it is possible to control the resistance of the sintered metal. Further, by selecting any desired content, it is possible to achieve an electrode member having porous sintered metal which realizes the uniform discharge and reduces the gradient of the V-I characteristic to less than 1 $\mu$A/V.cm inclusive. With such an electrode member, it is possible to control a small discharge current and to control the discharge level over a broad voltage range.

(9) The uniform voltage between the electrode member and the object and free from the bright point discharge frees from the body from, e.g., irregular charging.

(10) Assume that the V-I characteristic varies due to, e.g., the irregular thickness of the surface layer of the electrode member. Then, by defining a particular gap between the electrode member and the object, it is possible to prevent the discharge current flowing toward the object from rising sharply and discontinuously when the voltage around the discharge start voltage is applied to the electrode member. This also successfully obviates the glow point discharge.

(11) Because the surface of the electrode member moves endlessly, it is prevented from continuously facing the object at its same portion. Therefore, even when an irregular portion appears on the surface of the electrode member due to aging, it faces the object only for a short period of time. This allows the uniform discharge to be stably maintained.

(12) A contact member in the form of a brush contacts the electrode member either constantly or intermittently during discharge. The contact member sliding on the electrode member removes impurities including products derived from discharge from the surface of the electrode member. This extends the life of the electrode member and thereby preserves the uniform discharge over a long period of time.

(13) A latent image is formed on an image carrier uniformly charged by a discharge electric field forming device and is then developed. The resulting image is free from defects ascribable to irregular charging.

(14) Uniform or substantially uniform pretransfer charge is effected in order to enhance adhesion between the particles of toner and between the toner and the image carrier, thereby stabilizing the toner image. This prevents the toner adjoining the toner image from flying about and disfiguring it when the toner image is transferred to a recording medium. Particularly, in an image forming apparatus of the type using a developing liquid, the liquid is prevented from moving due to the pressure acting on the recording medium and a transfer electric field and separating the toner image into pieces. Moreover, because the variation of the discharge current for the unit variation of the voltage applied to the electrode member decreases, it is possible to control a small discharge current and therefore control the cohesion of the toner of the developed image and the deposition of the toner on the image carrier easily.

(15) The adhesion of the toner on the image carrier can be controlled optimally and flexibly in accordance with the variations of various conditions including the insulation of the liquid, image forming conditions, the characteristic of the image carrier, and the electric characteristic of the recording medium. This further enhances stable image transfer.

(16) The current flowing through the toner image charging device is monitored. This obviates an occurrence that the gap between the image carrier and a conductive roller or toner image charging device varies every moment due to the irregular dimensional accuracies of the image carrier, charge roller, bearings and so forth, thereby causing the current of the toner image charging device to vary. Specifically, a controller performs real-time detection of the variations of a current fed from the toner image charging device with a current monitor. Then, the controller generates current information for optimally controlling the transfer current of the image transferring device, and controls the current to be fed to the image transferring device. Therefore, it is possible to execute real-time control over the image transfer charge flexibly in accordance with the variation of the current of the toner image charging device.

(17) The current flowing through the image transferring device is monitored. This obviates the contamination of the charging device and belt due to, e.g., the liquid and paper dust particular to the conventional image transferring device, and the variation of current ascribable to the contamination. That is, the controller detects the variation of the current flowing through the image transferring device on a real-time basis and takes an adequate measure. This also ensures stable image transfer.

(18) At least one of the toner image charging device and image transferring device is implemented by a conductive roller. This allows a scraper or similar cleaning means to be held in sliding contact with the surface of the conductive roller. Such cleaning means is a simple measure against the contamination of the roller.

(19) When at least one of the toner image charging device and image transferring device is implemented by a corona charger, the uniform charge is achievable more easily.

(20) When at least one of the toner image charging device and image transferring device is implemented by a conductive brush, the cost of the apparatus can be reduced.

(21) Whether or not to use a transfer belt for transferring the toner image from the image carrier to the recording medium is open to choice. When such a belt is not used, a voltage fall due to the resistance of the belt does not occur. This allows desired charge to be achieved with a relatively low image transfer voltage and thereby simplifies the apparatus while reducing the cost and power consumption.

(22) When the transfer belt is formed of a material having a medium resistance, a voltage fall due to the resistance of the belt does not occur. This reduces the contamination of the image transferring device due to the liquid.

(23) When the transfer belt is formed of a material having a high resistance, there can be guaranteed the adhesion of the recording medium based on electrostatic charge remaining on the belt. As a result, the recording medium can be conveyed surely and efficiently.

Various modifications will become possible for those skilled in the art after receiving the teachings of the present disclosure without departing from the scope thereof.

What is claimed is:

1. A device which forms a discharge electric field to discharge an object, comprising:

an electrode member facing and separated from said object by a predetermined gap; and a power source which applies a discharge voltage to said electrode member to thereby cause discharge to occur between the object and said electrode member, said electrode member at said gap comprising a material selected in association with the gap so that a functional relationship between said discharge voltage and a discharge current caused by said discharge voltage is a continuous function.

2. A device as claimed in claim 1, further comprising a brush member contacting said electrode member at least when said discharge occurs between the object and the electrode member.

3. A device as claimed in claim 1, wherein said electrode member comprises a moveable surface.

4. A device as claimed in claim 1, further comprising a brush member intermittently contacting said electrode member at least when said discharge occurs between the object and the electrode member.

5. A device which forms a discharge electric field to discharge an object, comprising:

an electrode member facing and separated from said object by a predetermined gap; and a power source which applies a discharge voltage to said electrode member to thereby cause discharge to occur between the object and said electrode member, said electrode member at said gap comprising a porous sintered material selected in association with the gap so that a functional relationship between said discharge voltage and a discharge current caused by said discharge voltage is a continuous function.

6. A device as claimed in claim 5, wherein said surface layer has a thickness between 0.2 mm and 0.5 mm.

7. A device as claimed in claim 6, wherein said porous sintered metal is formed by plasma spraying.

8. A device as claimed in claim 7, wherein a material for plasma spraying comprises sintered metal whose major component is $Al_2O_3$.

9. A device as claimed in claim 8, wherein the material for plasma spraying comprises $Al_2O_3$—$TiO_2$.

10. A device as claimed in claim 8, wherein the material for plasma spraying comprises $Al_2O_3$—$Cr_2O_3$.

11. A device as claimed in claim 5, wherein said porous sintered metal has a porosity between 0.1% and 5%.

12. A device as claimed in claim 11, wherein said porous sintered metal is formed by plasma spraying.

13. A device as claimed in claim 12, wherein a material for plasma spraying comprises sintered metal whose major component is $Al_2O_3$.

14. A device as claimed in claim 13, wherein the material for plasma spraying comprises $Al_2O_3$—$TiO_2$.

15. A device as claimed in claim 13, wherein the material for plasma spraying comprises $Al_2O_3$—$Cr_2O_3$.

16. A device as claimed in claim 5, wherein said porous sintered metal is formed by plasma spraying.

17. A device as claimed in claim 16, wherein a material for plasma spraying comprises sintered metal whose major component is $Al_2O_3$.

18. A device as claimed in claim 17, wherein the material for plasma spraying comprises $Al_2O_3$—$TiO_2$.

19. A device as claimed in claim 17, wherein the material for plasma spraying comprises $Al_2O_3$—$Cr_2O_3$.

20. A device as claimed in claim 5, wherein said electrode member comprises a movable surface.

21. A device as claimed in claim 5, further comprising a brush member contacting said electrode member at least when said discharge occurs between the object and the electrode member.

22. A device as claimed in claim 5, further comprising a brush member intermittently contacting said electrode member at least when said discharge occurs between the object and the electrode member.

23. An image forming apparatus, comprising:

an image carrier which forms a latent image thereon;

a discharge electric field forming device which forms a discharge electric field between said discharge electric field forming device and said image carrier to thereby charge said image carrier;

latent image forming device which forms the latent image on said image carrier charged by said discharge electric field forming device;

a developing device which develops the latent image to thereby produce a corresponding toner image; and an image transferring device which transfers the toner image to a recording medium;

said discharge electric field forming device comprising:

an electrode member facing and separated from the image carrier by a predetermined gap; and a power source which applies a discharge voltage to said electrode member to thereby cause discharge to occur between the image carrier and said electrode member, said electrode member at said gap comprising a material selected in association with the gap so that a functional relationship between said discharge voltage and a discharge current caused by said discharge voltage is a continuous function.

24. An image forming apparatus, comprising:

latent image forming device which forms a latent image on an image carrier;

a developing device which develops the latent image to thereby form a corresponding toner image;

an image transferring device which transfers the toner image to a recording medium; and a discharge electric field forming device which forms a discharge electric field between said discharge electric field forming device and said image carrier;

said discharge electric field forming device comprising:

an electrode member facing and separated from the image carrier by a predetermined gap; and a power source which applies a discharge voltage to said electrode member to thereby cause discharge to occur between the image carrier and said electrode member, said electrode member at said gap comprising a material selected in association with the gap so that a functional relationship between said discharge voltage and a discharge current caused by said discharge voltage is a continuous function.

25. An image forming apparatus, comprising:

latent image forming device which forms a latent image on an image carrier;

a developing device which develops the latent image to thereby form a corresponding toner image;

an image transferring device which transfers the toner image to a recording medium; and a discharge electric field forming device which forms a discharge electric field between said discharge electric field forming device and said image carrier;

said discharge electric field forming device comprising:

an electrode member facing and separated from the image carrier by a predetermined gap; and a power source which applies a discharge voltage to said electrode member to thereby cause discharge to occur between the image carrier and said electrode member, said electrode member at said gap comprising a porous sintered material selected in association with the gap so that a functional relationship between said discharge voltage and a discharge current caused by said discharge voltage is a continuous function.

26. A device which forms a discharge electric field to discharge an object, comprising:

an electrode member facing and separated from said object by a predetermined gap; and a power source which applies a discharge voltage to said electrode member to thereby cause discharge to occur between the object and said electrode member, wherein said electrode member includes an aluminum base having at least a portion of a surface layer at said gap comprising alunite.

27. A device as claimed in claim 26, wherein said surface layer comprising alunite has a thickness greater than 35 $\mu$m inclusive.

28. A device as claimed in claim 26, wherein said predetermined gap is selected in association with the surface layer comprising alunite so that a functional relationship between said discharge voltage and a discharge current caused by said discharge voltage is a continuous function.

29. A device as claimed in claim 26, wherein said electrode member comprises a movable surface.

30. A device as claimed in claim 26, further comprising a brush member contacting said electrode member at least when said discharge occurs between the object and the electrode member.

31. A device as claimed in claim 26, further comprising a brush member intermittently contacting said electrode member at least when said discharge occurs between the object and the electrode member.

32. An image forming apparatus, comprising:

latent image forming device which forms a latent image on an image carrier;

a developing device which develops the latent image to thereby form a corresponding toner image;

an image transferring device which transfers the toner image to a recording medium; and a discharge electric field forming device which forms a discharge electric field between said discharge electric field forming device and said image carrier;

said discharge electric field forming device comprising:

an electrode member facing and separated from the image carrier by a predetermined gap; and a power source which applies a discharge voltage to said electrode member to thereby cause discharge to occur between the image carrier and said electrode member, wherein said electrode includes an aluminum base having at least a portion of a surface layer at said gap comprising alunite.

33. An electrophotographic apparatus, comprising:

a photoconductive element:

a toner image charging device which applies a first charge to said photoconductive element to form a toner image on said photoconductive element;

an image transferring device which applies a second charge to a recording medium to transfer the toner image to the recording medium; and a controller connected between the toner image charging device and the image transferring device and which controls said image transferring device to apply said second charge to be 20% to 100% of an amount of said first charge.

34. An apparatus as claimed in claim 33, wherein a current flowing through said toner image charging device is monitored.

35. An apparatus as claimed in claim 33, wherein a current flowing through said image transferring device is monitored.

36. An apparatus as claimed in claim 33, wherein at least one of said toner image charging device and said image transferring device comprises a conductive roller.

37. An apparatus as claimed in claim 33, wherein at least one of said toner image charging device and said image transferring device comprises a corona charger.

38. An apparatus as claimed in claim 33, wherein at least one of said toner image charging device and said image transferring device comprises a conductive brush.

39. An apparatus as claimed in claim 33, wherein a transfer belt is used to transfer the toner image from said photoconductive element to the recording medium.

40. An apparatus as claimed in claim 39, wherein said transfer belt is formed of a material having a medium resistance between 10E8 $\Omega$c $m^2$ and 10E12 $\Omega$c $m^2$.

41. An apparatus as claimed in claim 39, wherein said transfer belt is formed of a material having a high resistance higher than 10E14 $\Omega$c $m^2$ inclusive.

* * * * *

UNITED STATES PATENT AND TRADEMARK OFFICE

CERTIFICATE OF CORRECTION

PATENT NO. : 5,864,737

DATED : January 26, 1999

INVENTOR(S) : Makoto OBU et al.

It is certified that error appears in the above-identified patent and that said Letters Patent is hereby corrected as shown below:

On the title page, item [30], the first listed Foreign Application Priority Data should be:

--Sep, 28, 1995 [JP] Japan .....7-274685--

Signed and Sealed this

Twenty-ninth Day of June, 1999

*Attest:*

*Attesting Officer*

Q. TODD DICKINSON

*Acting Commissioner of Patents and Trademarks*